United States Patent [19]

Yagasaki

[11] Patent Number: 4,633,532

[45] Date of Patent: Jan. 6, 1987

[54] HELMET DEVICE

[75] Inventor: Akio Yagasaki, Tokyo, Japan

[73] Assignee: Honda Giken Kogyo Kabushiki Kaisha, Tokyo, Japan

[21] Appl. No.: 648,343

[22] Filed: Sep. 6, 1984

Related U.S. Application Data

[63] Continuation of Ser. No. 372,708, Apr. 28, 1982, abandoned.

[30] Foreign Application Priority Data

May 1, 1981 [JP] Japan ..... 56-64597[U]
May 27, 1981 [JP] Japan ..... 56-80379

[51] Int. Cl.[4] ..... A42B 3/02

[52] U.S. Cl. ..... 2/424; 2/438; 2/435; 15/250.3

[58] Field of Search ..... 2/422, 423, 424, 410, 2/438, 435, 6; 242/107.6, 107.7; 15/250.3; 219/211

[56] References Cited

U.S. PATENT DOCUMENTS

| | | | |
|---|---|---|---|
| 1,795,866 | 3/1931 | King | 2/6 X |
| 3,024,341 | 3/1962 | Ogle, Jr. et al. | 219/211 X |
| 3,027,561 | 4/1962 | Senne | 2/435 |
| 4,027,354 | 6/1977 | Burpee | 2/438 X |
| 4,114,736 | 9/1978 | Scherenberg | 242/107.6 X |
| 4,215,437 | 8/1980 | Kao | 2/424 |

FOREIGN PATENT DOCUMENTS

| | | | |
|---|---|---|---|
| 2838462 | 3/1980 | Fed. Rep. of Germany | 2/438 |
| 2407680 | 6/1979 | France | 2/422 |
| 0264280 | 1/1927 | United Kingdom | 2/435 |

*Primary Examiner*—Peter Nerbun
*Attorney, Agent, or Firm*—Irving M. Weiner; Joseph P. Carrier; Pamela S. Burt

[57] ABSTRACT

A helmet device including a helmet body having an open front portion and a shielding mechanism attached to the helmet body so as to substantially shield such front portion of the helmet body. The shielding mechanism includes a see-through member permitting an outside view therethrough and a wiper mechanism for wiping the outer surface of the see-through member. The helmet device eliminates any need for manually wiping away raindrops or the like adhering to the outer surface of the see-through member, even when the helmet device is used in the rain or like conditions.

7 Claims, 11 Drawing Figures

HELMET DEVICE

This is a continuation of application Ser. No. 372,708, filed Apr. 28, 1982 now abandoned.

BACKGROUND OF THE INVENTION

1. Field of the Invention

The present invention relates generally to a helmet device to be worn when riding a motorcycle or the like. More particularly, the invention relates to such a helmet device which is provided with a face shield member.

2. Description of Relevant Art

A known helmet device to be worn when riding a motorcycle or the like, particularly by the driver, is provided with a shielding member which is commonly referred to as a "face shield". The face shield is mounted in a front opening portion of the helmet body so as to selectively open and close the opening portion, and is see-through so as to permit the driver to see ahead while driving, while shielding the driver's face from rain or like conditions.

While driving, raindrops, insects and/or road debris tend to adhere to the outer surface of the face shield. Further, the inner surface of the face shield may become fogged due to the difference in temperature between the outside air and the inner surface of the face shield, which is positioned just in front of the wearer's face. When the driver's visibility through the face shield is blocked under such conditions, the driver has heretofore been compelled to manually wipe the outer surface of the face shield, or to push up the face shield so as to manually wipe the inner surface thereof. The inconvenience of such manual wiping operations has resulted in a desideratum for a helmet device which effectively eliminates the need for such manual wiping operations.

The present invention effectively overcomes the disadvantages heretofore associated with known helmet devices provided with a face shield, and effectively fulfills the aforesaid desideratum.

SUMMARY OF THE INVENTION

The present invention provides a helmet device comprising a helmet body having an open front portion and a shielding unit attached to the helmet body so as to substantially shield the front portion, the shielding mechanism having a see-through member which permits an outside view therethrough and a wiper mechanism for wiping the outer surface of the see-through member.

It is an object of the present invention to provide a helmet device which eliminates the need for manually wiping away raindrops or the like on the outer surface of a see-through shield member, even when the helmet device is used in the rain or like conditions.

A further object of the present invention is to provide a helmet device which eliminates the need for manually wiping fog or the like from the inner surface of the see-through shield member, even when the helmet device is used on a rainy or cold day.

Another object of the present invention is to provide a helmet device which maintains the inside atmosphere thereof in a fresh condition without requiring moving of the see-through screen.

It is still a further object of the present invention to provide a helmet device which can supply electric power for attaining the foregoing objects while avoiding interference with the helmet wearer's use of the helmet.

The above and further objects, features and advantages of the present invention will become apparent from the following detailed description, when read in conjunction with the accompanying drawings.

DETAILED DESCRIPTION OF PREFERRED EMBODIMENTS

Figure 1:
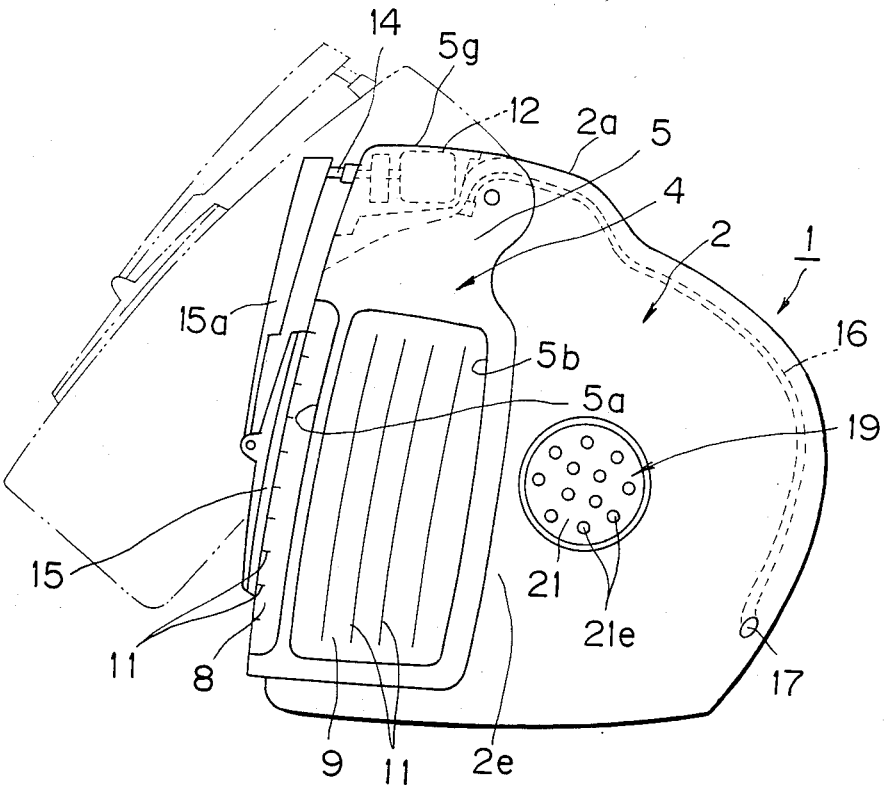
FIG. 1 is a side view of a helmet device in accordance with a preferred embodiment of the present invention.
Figure 2:
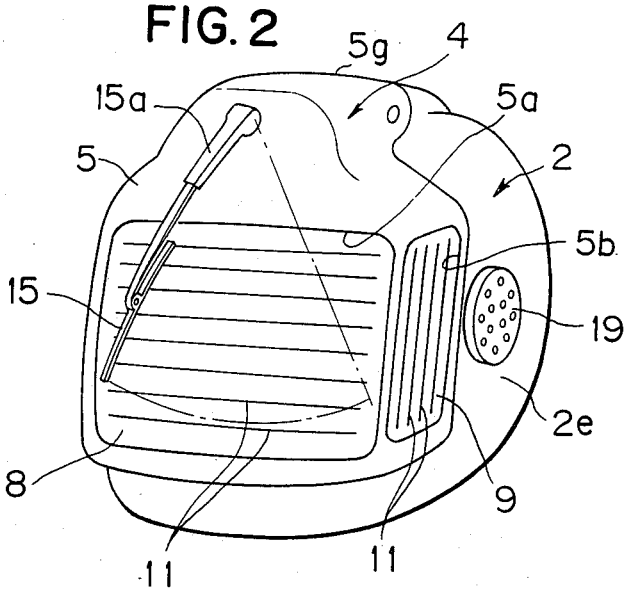
FIG. 2 is a perspective view of the helmet device of FIG. 1.
Figure 3:
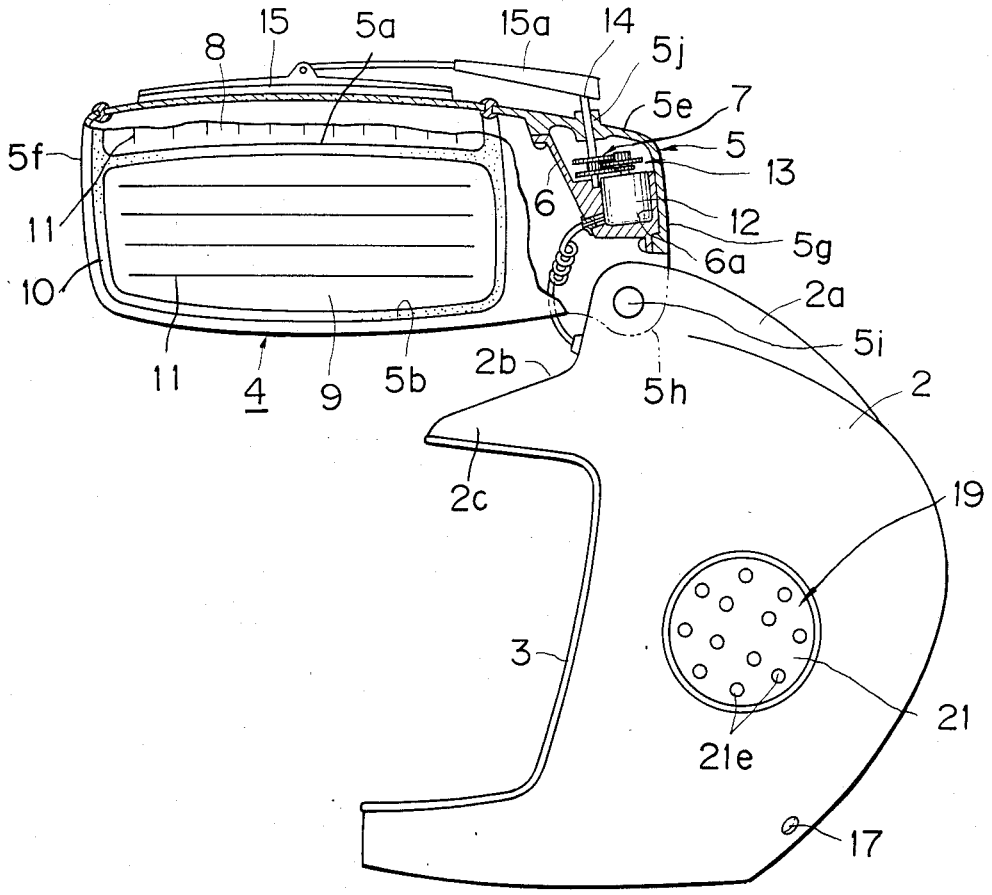
FIG. 3 is an enlarged side view showing a pushed-up state of a face shield unit of the FIG. 1 helmet device.

With reference to FIGS. 1 through 5, and particularly to FIG. 3, there is shown a helmet 1 adapted to be worn by a motorcycle driver or other user, the helmet 1 having a body 2 in a front portion of which is formed an opening portion 3 which faces the front as well as the right and left sides of the wearer's face. At the top of the body 2 and on a central part in the width direction thereof is integrally formed a projecting portion 2*a*, the front part of which is lowered to form a stepped portion 2*b* which defines a peak portion 2*c* above a front head portion.

Figure 4:
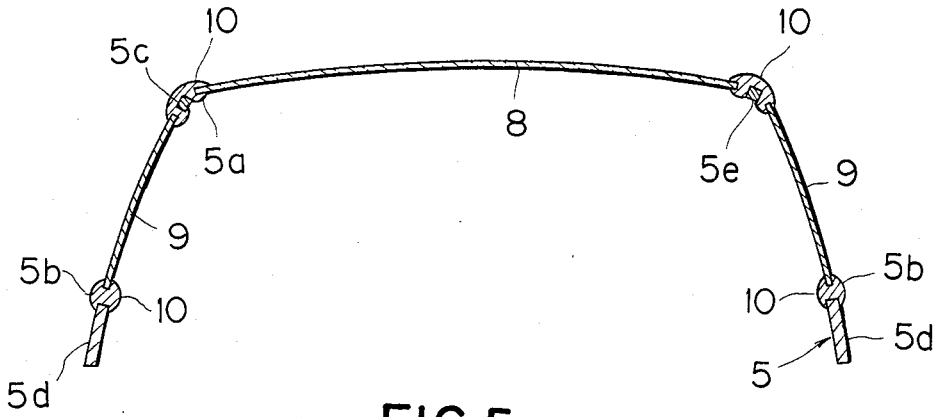
FIG. 4 is a transverse sectional view of the face shield unit shown in FIG. 3.
Figure 5:
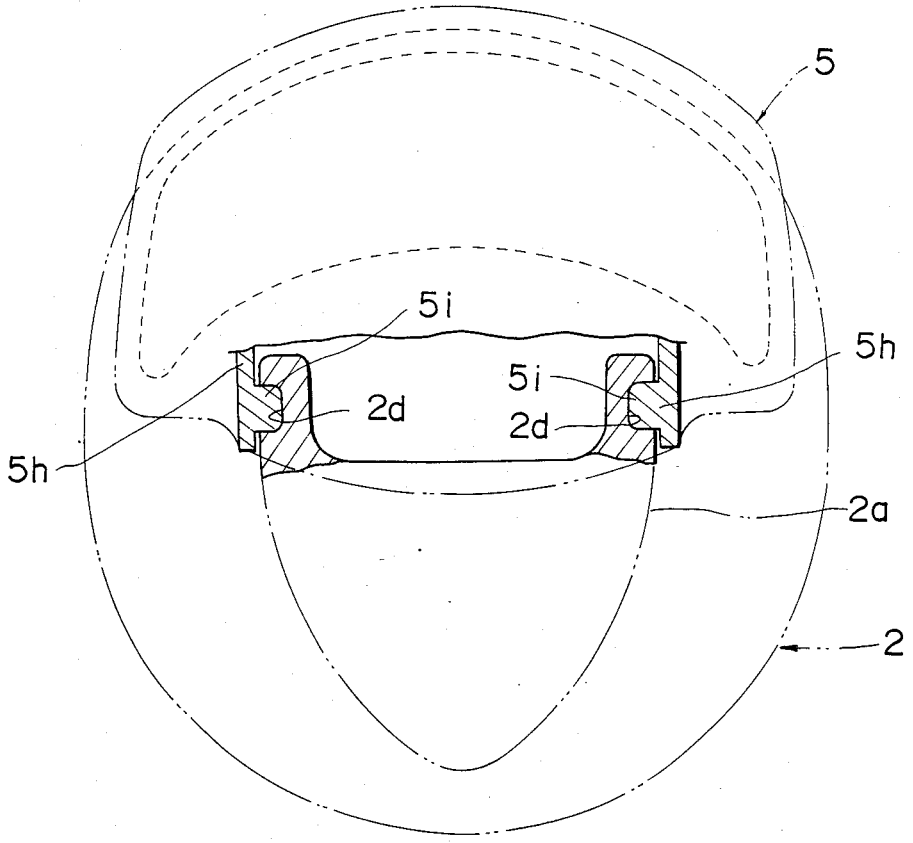
FIG. 5 is a partially cut-away schematic top view showing a mounting portion of the FIG. 3 face shield unit.
Figure 9:
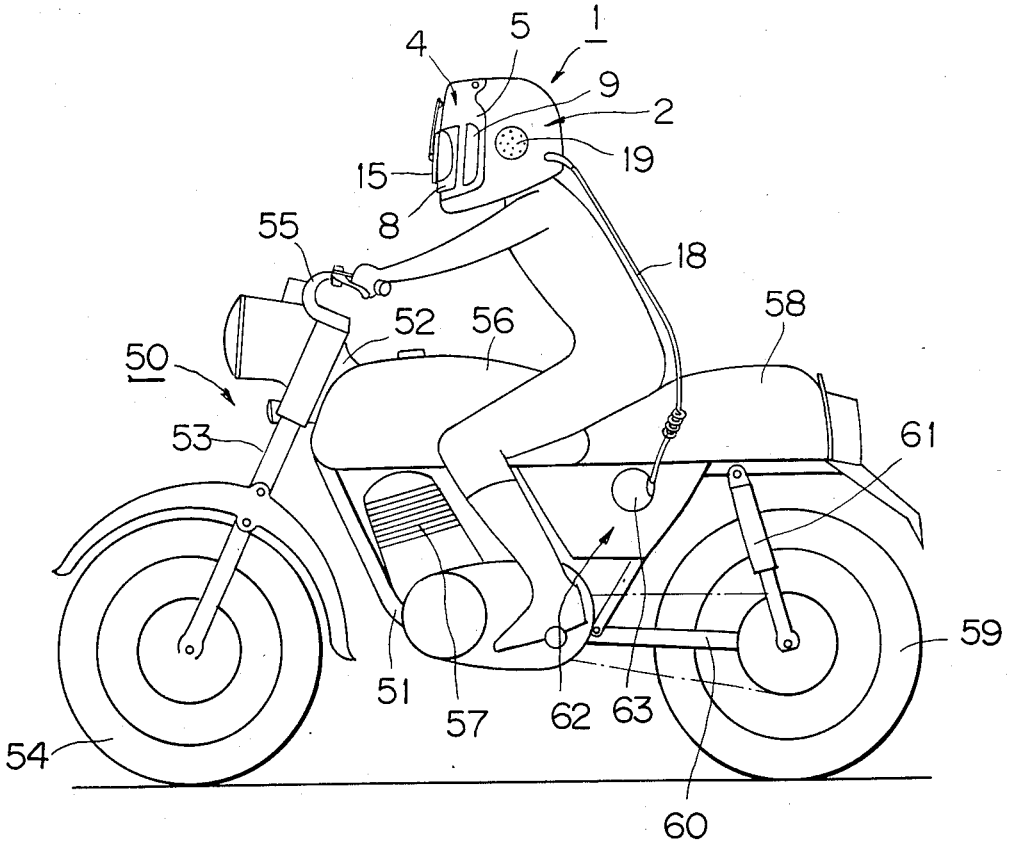
FIG. 9 illustrates the helmet device of FIG. 1 worn by a driver seated on a motorcycle.

In front of the body 2 of the helmet 1 there is disposed a face shield mechanism or unit 4 adapted to open and close the opening portion 3. As shown in FIGS. 3 and 4, the face shield unit 5 has a body 5 which is substantially channel-shaped in cross section (FIG. 4), and a motor chamber 7 is defined by a partition wall 6 in an upper portion of the body 5. In the front and both sides of the body 5 are formed openings 5*a*, 5*b* and 5*b*, respectively, which are defined at the respective right and left portions by longitudinal pillars 5*c*, 5*c* and side walls 5*d*, 5*d*, and the top and bottom portions thereof are defined by an upper wall 5*e* and a lower edge 5*f*. In the openings 5*a*, 5*b* and 5*b* are fitted see-through shield members 8, 9 and 9, respectively, such as glass plates or the like, by means of weather strips 10. The member 8 comprises a front face shield member of the face shield unit and the members 9 comprise side shield members of the face shield unit. Heating wires 11, which comprise at least one filament member imprinted on the shield members 8 and 9, generate heat when power is fed from a power source (not shown) to prevent the shield members from becoming fogged. As shown in FIG. 4, the surface of the front face shield member 8 has a gentle curvature which is substantially flat so as to improve the follow-up performance of a wiper blade 15 as will be described hereinbelow. Because the front face shield member 8 is rendered nearly flat, the side shield members 9 are mounted separately to ensure side views. If a face shield material is employed which is flexible enough to permit both side ends thereof to be bent at substantially a right angle, the sides 9 may be formed integrally with the front 8. In other words, whether formed separately or integrally with the front face shield member 8, each of the side shield members 9 extends rearwardly from front face shield member 8 while forming a corner therebetween. As shown in FIG. 9, each of the side shield members 9 cover an area extending between the side of front face shield member 8 and the helmet body 2.

The body 5 of the face shield unit 4 has a top portion 5*g*, and at the right and left of the rear end of top portion 5*g* are formed extending walls 5*h*, each having an inwardly projecting pin portion 5*i* formed on the inner surface thereof. At the right and left of the front part of the projecting portion 2*a* of the helmet body 2 are formed recesses 2*d*, in which are fitted the pin portions 5*i*, whereby the upper portion of the face shield unit body 5 is pivoted to the upper portion of the helmet body 2. In this manner, as shown in FIG. 3, the body 5 is upwardly pivotally movable with the pin portions 5*i* as fulcrums so as to open the opening portion 3 of the helmet body 2, and as shown in FIGS. 1 and 2 the body 5 can be pivotally moved downwardly to close the opening portion 3.

A wiper motor 12 is disposed within the space 7 at the upper portion of the body 5 of the face shield unit 4 (FIG. 3), the space 7 being surrounded by the partition wall 6, the upper wall 5*e*, and the top wall 5*g*. The motor 12 is fitted in and supported by a recess 6*a* formed in part of the partition wall 6 and a reduction mechanism 13 comprising gears, etc. is connected to an output shaft of the motor 12. A tip end of a wiper driving shaft 14 is extended ahead of the upper wall 5*e* from a bearing boss portion 5*j* formed centrally in the width direction of the upper wall 5*e*, with a base portion of an arm 15*a* of a wiper blade 15 being pivotably fixed to the thus-extended tip end of the wiper driving shaft 14. The blade 15 is capable of wiping substantially the entire substantially flat outer surface of the front shield member 8 by pivotal movement thereof about the shaft 14, and is operated by means of a switch or the like (not shown).

In the event that the inner surfaces of the shield members 8 and 9 become fogged due to the difference in temperature between the inside and the outside of the helmet when driving in the rain or like conditions, electric power is fed to the heating wires 11 by operating a switch or the like (not shown) to clear the shield members of such fogging. Thus, along with the aforesaid wiping-off operation, visibility can be ensured. Side views are also improved because the heating wires 11 are also imprinted on the side shield members 9.

Within the helmet body 2 (FIG. 1) and along the top and rear walls thereof a harness 16 is disposed for supplying electric power to the motor 12 and also to the heating wires 11. The harness 16 is concealed by a lining material or the like in the body 2 so as not to be exposed to the inner surface of the body 2, with its input end being connected to a power jack 17 disposed at a rear and lower portion of the body 2, which is in turn connected to a feeder cord (not shown) through a plug and further connected to a power source (not shown).

Figure 6:
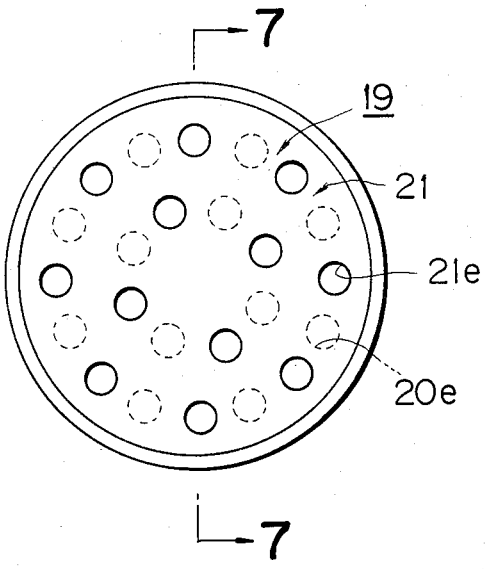
FIG. 6 is an outside view of a ventilation mechanism in the helmet device of FIG. 1.
Figure 7:
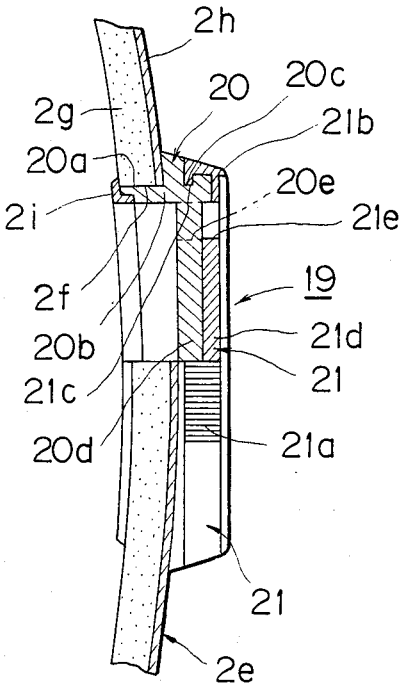
FIG. 7 is a half-cut side view showing a mounting portion of the ventilation mechanism of FIG. 6.

In a center portion of both or at least one of the right and left side walls 2*e* of the helmet body 2 there is mounted a ventilation unit 19 for establishing communication between the inside of the body 2 and the outside air. The ventilation unit 19, as shown in detail in FIGS. 6 and 7, has a substantially saucer-shaped base member 20, the base member 20 having a drum portion 20*a* which is fitted in the inner periphery of a substantially circular opening 2*f* formed in the side wall 2*e* of the body 2 so that the outer periphery of the drum portion 20*a* is in close contact with an inner cushioning material 2*g* and an outer plate portion 2*h* of the body 2. The drum portion 20*a* is fixed at the inner end thereof with a support ring 2*i* so as to be held in the opening portion 2*f*. The base member 20 is provided with a flange 20*b* which extends outwardly from the outside plate portion 2*h*. The flange 20*b*, which is larger in diameter than the opening portion 2*f*, also serves as a stopper in the axial direction and is provided in an intermediate outer peripheral portion thereof with a ring-like groove 20*c*. The inner opening of the flange 20*b* is closed by a circular wall 20*d*. Outside the base member 20 is disposed a gapped cover member 21, the cover member 21 having a substantially circular wall 21*d* overlapping the wall 20*d* to entirely cover same, a drum portion 21*b* formed at the outer periphery thereof, and an inward flange 21*c* formed on the inner periphery of the drum portion 21*b*, which is adapted to engage the groove 20*c*. The circular wall 21*d* is disposed on the outside surface of the circular wall 20*d* and the flange 21*c* is brought into engagement with the groove 20*c*, whereby the cover member is angularly movable with respect to the base member 20. Further, in order to facilitate such angular movement and to prevent the cover member 21 from slipping when operating, a knurl 21*a* may be formed on the outer periphery of the member 21. In the circular walls 20*d* and 21*d* are formed a plurality of through holes 20*e* and 21*e*, respectively, formed on a plurality of pitch circles. By changing phase in the rotational direction with respect to the fixed side base member 20 while turning the outside cover member 21, the through holes 20*e* and 21*e* are overlapped with each other to thereby permit communication between the inside of the helmet body and the outside air. Therefore, a desired amount of ventilation can be selected by adjusting the amount of overlap between the through holes 20*e* and 21*e*. The exchange of stagnant air within the helmet and prevention of fogging of the shield members can thus be attained without the need of pushing up the face shield unit 4 as shown in FIG. 3.

In the foregoing manner, the air in the helmet is ventilated and inside and outside temperatures are equalized by adjusting the amount of ventilation, whereby fogging of the shield members, otherwise caused by an entire covering of the wearer's head, can be prevented from occurring. Further, it is possible to hear outside sounds clearly while entirely covering the wearer's head with the helmet.

Figure 8:
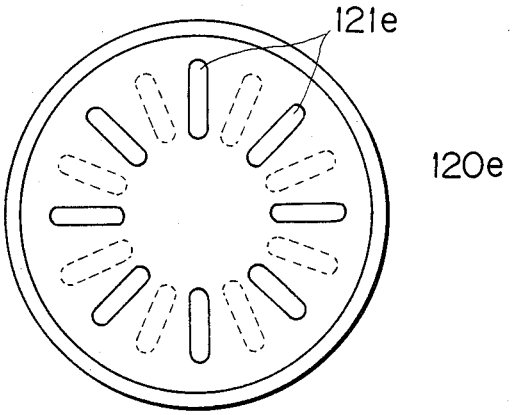
FIG. 8 is a view similar to FIG. 6, showing another example of a ventilation mechanism.

The aforesaid communication holes may comprise slit-like, radially-long apertures 120*e* and 121*e* as shown in FIG. 8. Such holes may be formed in any desired shape, and although in the present embodiment their opening and closing operations are controlled by angular movement, such operations may alternatively be controlled by a linear sliding motion.

Figure 10:
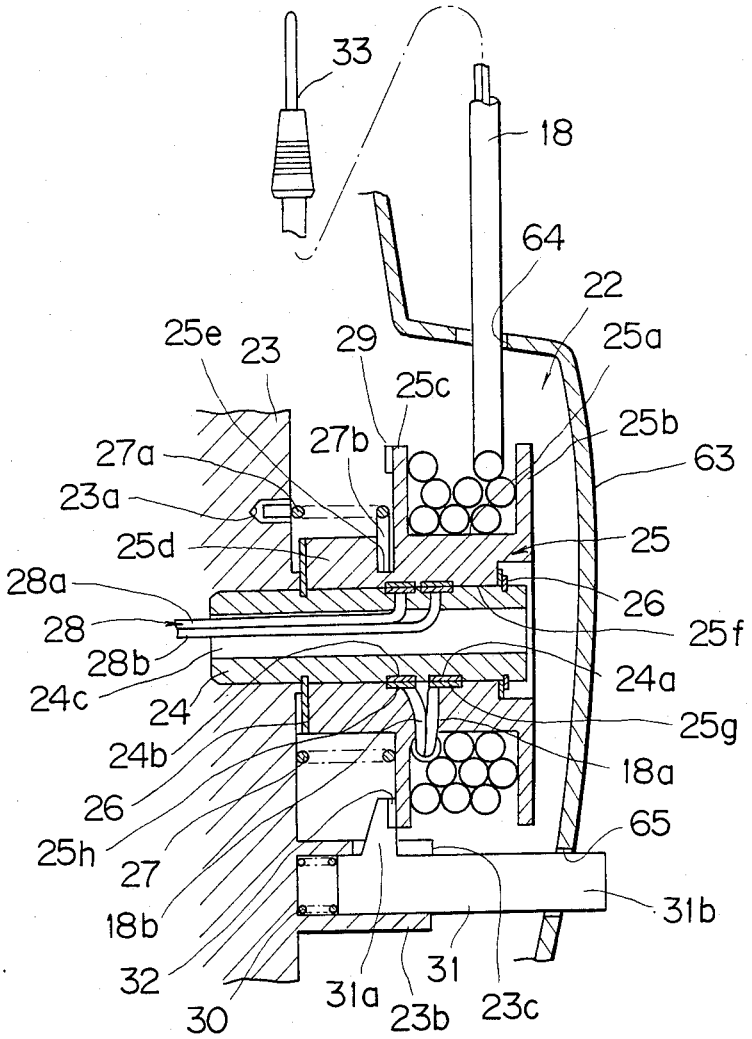
FIG. 10 is a longitudinal sectional view of a power supply system in the helmet device of FIG. 1, disposed in the motorcycle shown in FIG. 9.
Figure 11:
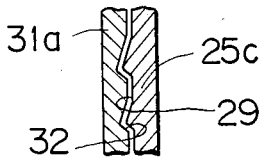
FIG. 11 is an enlarged segmented view of an engaging mechanism in the power supply system of FIG. 10.

With reference now to FIGS. 9 through 11, there is shown a power supply system in the helmet device according to the invention, wherein the reference numeral 50 designates a motorcycle. The motorcycle 50 includes a front fork 53 which supports a front wheel 54 pivoted for steering operation to a head tube 52 at the front end of a frame 51, and a handlebar 55 is mounted above the front fork 53. On an upper front portion of the frame 51 is mounted a fuel tank 56, while on a lower portion thereof is mounted an engine 57. Behind the fuel tank 56 is disposed a seat 58, and to a lower rear portion of the frame 51 is pivoted a rearwardly extending rear fork 60 for supporting a rear wheel 59, with a rear cushion unit 61 being interposed between the rear portion of the rear fork 60 and an upper rear portion of the frame 51.

A battery box 62 is mounted below the front portion of the seat 58, with the outside thereof being covered by a cover 63, and a power supply unit 22 (FIG. 10) is mounted in the interior of one side of the box 62. The power supply unit 22 has a case 23 which is mounted on a part of the frame 51, and a support shaft 24 is attached to a part of the case 23 so that it extends outwardly, with a pulley 25 being rotatably fitted over the extending portion of the support shaft 24. The pulley 25 is provided with a channel **25*a* for winding thereon a power supply cord 18, the channel being defined by right and left flanges 25*b* and 25*c***.

The pulley 25 is secured in its axial position on the support shaft 24 by clips 26 disposed at the tip end portion and base portion of the shaft 24. A return spring 27 is wound around the outer periphery of a boss portion **25*d* formed on the inner side of the pulley 25, and one end 27*a* of the spring 27 is retained in a recess 23*a* formed in the case 23, while the other end 27*b* is anchored in a recess 25*e* formed in the boss portion 25*d*, thereby imparting a resilient turning force in the winding direction to the pulley 25. The cord 18 as wound around the pulley groove 25*a* is delivered from a take-out hole 64 formed in the cover 63. Positive and negative lead wires 18*a* and 18*b* of the cord 18 are respectively connected, through a radial passage 35 formed in the hub portion of the pulley 25, to slip ring terminals 25*g* and 25*h* which are mounted on the inner peripheral surface of the pulley 25. The terminals 25*g* and 25*h* are respectively in contact with slip ring terminals 24*a* and 24*b* which are mounted on the outer periphery of the shaft 24 in positions opposed to the terminals 25*g* and 25*h*, the terminals 24*a* and 24*b* being respectively connected to lead wires 28*a* and 28*b* of a power cord 28 which extends through a hollow portion 24*c* of the shaft 24. The shaft 24 and the pulley 25** are each formed of an electrically-insulative material.

One-way teeth 29 are formed on and along a radially outer edge portion of the inside flange **25*c* of the pulley 25. A push rod 31 extending in parallel with pulley support shaft 24 is axially movably supported in a guide sleeve 23*b* formed on the case 23, the push rod 31 being axially biased with a spring 30. The guide sleeve 23*b* is provided in a circumferential part thereof with an axial notch 23*c*, and a stopper 31*a* projecting sideways from one side of the rod 31 is engaged with the notch 23*c*. The stopper 31*a* is provided with one-way teeth 32 which are brought into pressure contact with the teeth 29 by the force of the spring 30, thereby preventing the pulley 25 from rotating in its returning direction by the force of the spring 27. On the other hand, rotation of the pulley 25 in the direction of delivery of the cord 18 is allowed against the spring 27. The teeth 32 and 29 thus comprise a one-way clutch and hold the pulley 25 against a return bias of the spring 27 to keep the required length of the cord extended. A distal end 31*b* of the rod 31 projects from a hole 65 formed in the cover 63, and by pushing or sliding back the rod 31 through the projecting end 31*b* against the spring 30 the teeth 32 and 29 are disengaged from each other to relieve the pulley 25 from restraint, thus allowing the pulley 25 to rotate in the winding direction by the force of the spring 27 to wind the cord 18 thereon. Therefore, even when the cord 18 is drawn out and connected through a plug 33 to the jack 17 of the helmet 1, the winding load of the cord 18 will never be imposed on the helmet 1**.

The present invention also contemplates that, in a construction as described hereinabove but without the provision of the face shield unit 4, a face shield member may be attached directly to the front and sides of the body of the helmet 1 and a wiper motor may be mounted within an upper portion of the helmet.

Although there have been described what are at present considered to be the preferred embodiments of the invention, it will be understood that the invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A helmet device comprising:

a helmet body having an open front portion;

a shielding mechanism attached to said helmet body so as to substantially shield said front portion of said helmet body;

said shielding mechanism having an upper portion thereof pivotably connected to an upper portion of said said helmet body and including a see-through member which permits an outside view therethrough;

wiper means for wiping the outer surface of said see-through member;

said see-through member comprising:

a front face shield member having a substantially flat gentle curvature; and side shield members connected to respective sides of said front face shield member;

said wiper means comprising a wiping member disposed so as to come into sliding contact with the outer surface of said see-through member, and means for driving said wiping member, said driving means comprising an electric motor disposed above said front face shield member and extending rearwardly within said upper portion of said shielding mechanism;

said wiper means being adapted to wipe an area within the substantially flat outer surface of said front face shield member;

each said side shield member being adapted to cover an area extending between the side of said front face shield member and said helmet body, and being connected to said front face shield member so as to form a corner therebetween, and extending rearwardly; and said shielding mechanism including a pair of pivot members through which it is pivotably connected with said helmet body, said pivot members being positioned above said side shield members and exteriorly of the respective sides of said driving means.

2. A helmet device according to claim 1, wherein:

said helmet is provided with an electric device and a connector member fixed to said helmet body, said electric device being electrically connected with said connector member, said electric device comprising heating means provided on said shielding mechanism for heating said see-through member; and said heating means comprises at least one filament member disposed in said see-through member, said filament member being adapted to be heated electrically.

3. A helmet device according to claim 2 wherein:

said connector member and said electric device are electrically connected with each other through a harness arranged inside said helmet body.

4. A helmet device according to claim 1, wherein:

said helmet body comprises ventilation means disposed at a center portion of a side wall of said helmet body, said ventilation means comprising at least one ventilating hole and an adjusting mechanism adapted to adjust the opening area of said ventilating hole; and said adjusting mechanism comprises a movable member having an opening adapted to overlap said ventilating hole.

5. A helmet device according to claim 1, further comprising:

a power source mounted on a motorcycle;

a cord member having one end thereof electrically connected to said power source;

an accommodation mechanism mounted on said motorcycle for deliverably accommodating said cord member, said accomodation mechanism being disposed substantially rearwardly of the rider's position of said motorcycle and being mounted within a battery compartment of said motorcycle;

a connector member fixed to said helmet body, said connector member being disposed in the lower rear portion of said helmet body; and said cord member having the other end thereof detachably connected to said connector member.

6. A helmet device according to claim 5, wherein:

said accommodation mechanism comprises a rotatable pulley member having said cord member wound thereon, a resilient member for biasing said pulley member in a winding direction of said cord member at all times, and restriction means for restricting the rotation of said pulley member in said winding direction; and said restriction means comprises a plurality of first teeth formed on said pulley member, a plurality of second teeth engageable with said first teeth, and an operating mechanism for moving said first and second teeth into engagement and disengagement with respect to each other.

7. A helmet device according to claim 3, wherein:

said harness is disposed along a top wall and a rear wall of said helmet body; and said connector member is in the lower rear portion of said helmet body.

* * * * *